United States Patent [19]

Carroll

[11] 4,154,023

[45] May 15, 1979

[54] REVOLVING DOORS

[75] Inventor: Noel Carroll, Melbourne, Australia

[73] Assignee: B.W.N. Industries Pty. Ltd., Victoria, Australia

[21] Appl. No.: 803,670

[22] Filed: Jun. 6, 1977

[30] Foreign Application Priority Data

Dec. 7, 1976 [AU] Australia ..... PC8386

[51] Int. Cl.[2] ..... E05F 15/10; E05D 15/02

[52] U.S. Cl. ..... 49/32; 49/43

[58] Field of Search ..... 49/32, 43, 42, 29, 28, 49/27, 334; 318/210, 613

[56] References Cited

U.S. PATENT DOCUMENTS

| | | | |
|---|---|---|---|
| 2,442,406 | 6/1948 | Gates | 318/210 X |
| 2,886,756 | 5/1959 | Schaefer | 318/210 |
| 2,954,971 | 10/1960 | Simpson | 49/43 X |
| 3,424,959 | 1/1969 | Gruner | 318/613 |
| 3,470,653 | 10/1969 | Kalog | 49/334 X |
| 3,497,997 | 3/1970 | Sheckells | 49/43 |
| 3,526,820 | 9/1970 | Sheckells | 49/43 X |
| 3,678,623 | 7/1972 | Jenkins | 49/43 |
| 3,903,647 | 9/1975 | Hubbard et al. | 49/27 |

*Primary Examiner*—Philip C. Kannan

*Attorney, Agent, or Firm*—Spensley, Horn & Lubitz

[57] ABSTRACT

A revolving door comprising at least one upright door element arranged in outwardly extending disposition about an upright axis of revolution, motor means being provided together with control means operable to position the door at a first rotational disposition from which, when the door is turned in one direction by a user pushing against said door element, power assistance is given to the door to effect rotation thereof; limit means being provided to cause the door to then come to rest at said first rotational disposition, in the absence of continued pushing by said user, after movement of the door under action of said motor means.

7 Claims, 17 Drawing Figures

Fig. 7
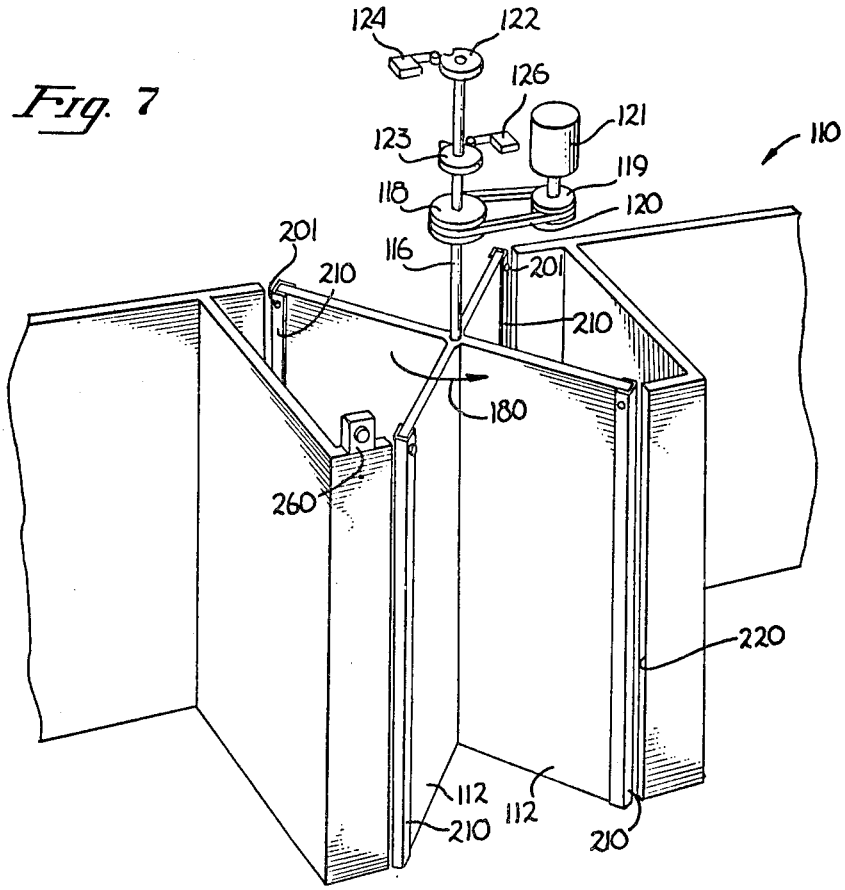
Fig. 8
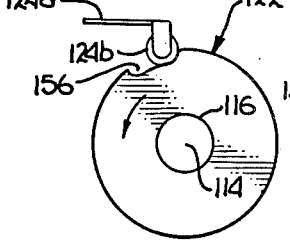
Fig. 9
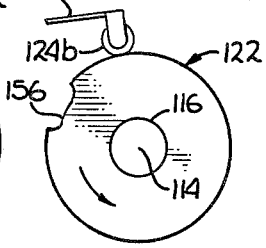
Fig. 10
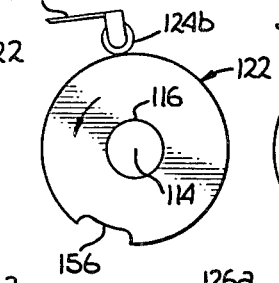
Fig. 11
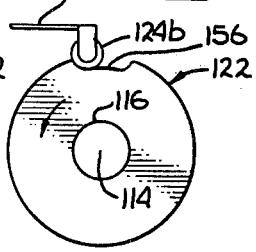
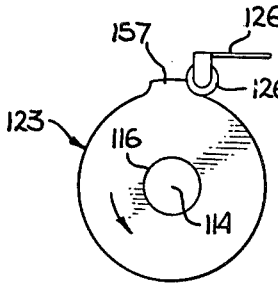
Fig. 12
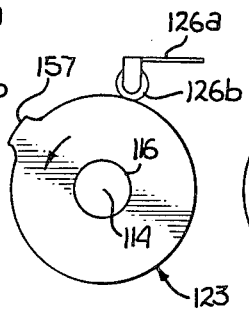
Fig. 13
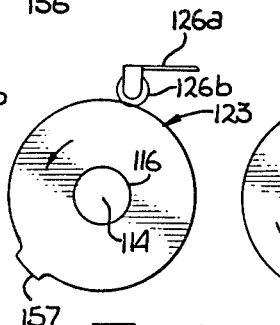
Fig. 14
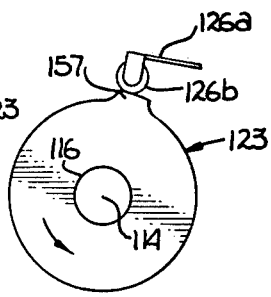
Fig. 15

REVOLVING DOORS

BACKGROUND OF THE INVENTION (i) Field of the Invention

This invention relates to revolving doors.

(ii) Prior Art

Revolving doors are customarily hand operated, a user merely pushing against the door in order to impart rotation thereto. Although arrangements are known in which revolving of the door is effected by a motor which is set into operation by the user, such arrangements are not entirely satisfactory. Particularly, they will normally be operated by a user by actuation of an electrical switch, and users may find operation of the switch inconvenient. To some extent this difficulty may be overcome by incorporating suitable sensing means into the electric switch so that, for example, the switch is actuated when a user's hand is in promimity to the door. Even this, though, is not completely satisfactory since experience has shown that users unfamiliar with doors of this kind will have difficulty in understanding what actions are necessary to operate the door, even when explanatory notices are provided.

The invention has for its object to provide a revolving door which has provision for power assistance but which is relatively simple to operate.

BRIEF DESCRIPTION OF THE INVENTION

According to the invention there is provided a revolving door comprising at least one upright door element arranged in outwardly extending disposition about an upright axis of revolution, motor means being provided together with control means operable to position the door at a first rotational disposition from which, when the door is turned in one direction by a user pushing against said door element, power assistance is given to the door to effect rotation thereof; limit means being provided to cause the door to then come to rest at said first rotational disposition, in the absence of continued pushing by said user, after movement of the door under action of said motor means.

BRIEF DESCRIPTION OF THE SEVERAL VIEWS OF THE ACCOMPANYING DRAWING

FIG. 7 is a diagrammatic perspective view of a revolving door constructed in accordance with the invention;

FIGS. 8 to 11 are plan views of a first cam controlling operation of the door, this cam being shown at four consecutively occurring rotational dispositions;

FIGS. 12 to 15 are plan views of a second cam controlling operaton of the door, this cam being shown at four consecutively occurring rotational dispositions corresponding approximately to the respective dispositions of the first cam as shown in FIGS. 8 to 11 respectively;

DETAILED DESCRIPTION

Figure 1:
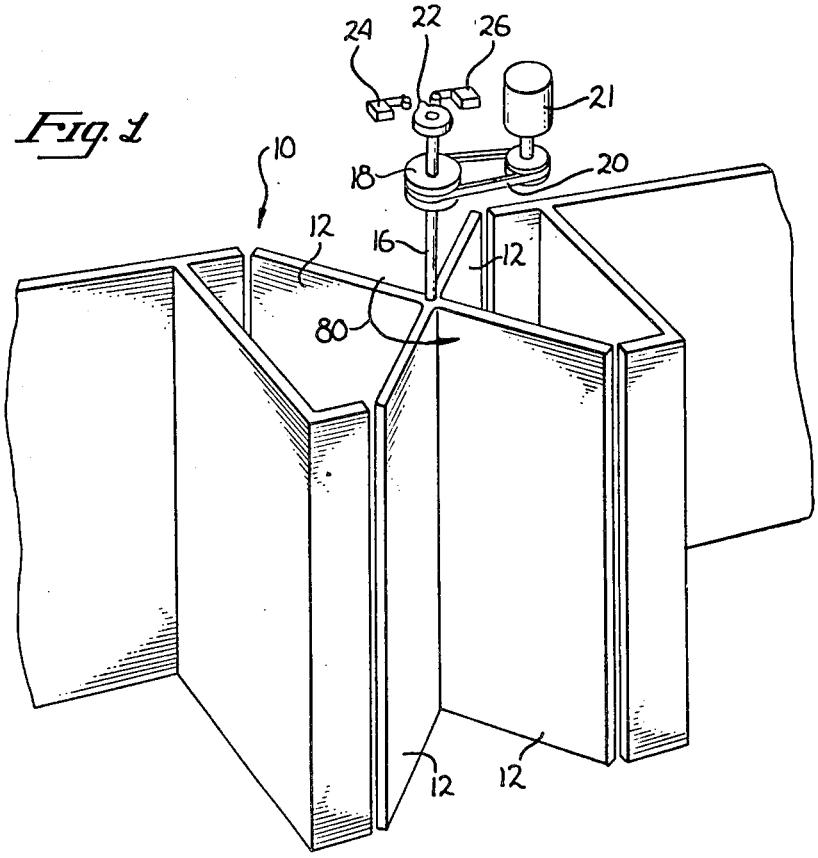
FIG. 1 is a fragmentary diagrammatic view of a revolving door constructed in accordance with the invention.

The door 10 shown in FIGS. 1 to 6 includes four upright planar door panels 12 which are arranged so as to extend outwardly in radial fashion from a common upright axis of rotation. The panels are so mounted that the door can be revolved about the upright axis by a user pushing against one of the door panels 12 in a manner well known per se.

A shaft 16 at the upper end of the door and coaxial with the axis from which door panels 12 extend is driven from a pulley 18 via an endless belt 20 from an electric motor 21. The upper end of shaft 16 carries a cam 22 which co-operates with two microswitches 24, 26 to control operation of motor 22. As best seen from FIGS. 2 to 5, cam 22 is principally of circular configuration having an outer peripheral portion 58 which extends substantially around the entire perimeter thereof, portion 58 being of constant radius as measured from the axis 14 of shaft 16. A single outward lobe 56 is provided on the cam periphery.

The operating arms 24*a*, 26*a* of the two microswitches 24, 26 carry rollers 24*b*, 26*b* which engage the periphery of cam 22 at closely spaced locations. Contacts of switches 24, 26 are arranged in a control circuit 60 which supplies electrical current to motor 21. Circuit 60 includes a transformer 62 having its primary winding 64 coupled to terminals 66*a*, 66*b* of an alternating current supply 66. The secondary winding 66 of transformer 62 is a low voltage winding and it is coupled across input terminals 68*c*, 68*d* of a bridge rectifier 68. A filter capacitor 70 is coupled across the output terminals 68*a*, 68*b* of rectifier 68 so that the output from the rectifier on terminals 68*a*, 68*b* is, substantially, a direct current voltage. Microswitch 24 is connected in series with a timing circuit 33 of a kind known per se, these together being coupled across terminals 68*a*, 68*b* so that when microswitch 24 is momentarily operated, a voltage is applied to timing circuit 33 to cause it to close normally open contacts 33*a* associated therewith for a predetermined period of time. Contacts 33*a* are connected in series with a relay coil 28, the contacts and relay coil together being coupled across terminals 68*a*, 68*b* so that when contacts 33*a* are operated the relay coil 28 is energised. Microswitch 26 is connected in series with a relay coil 30, these together being connected across terminals 68*a*, 68*b* so that when switch 26 is operated relay coil 30 is energised.

Motor 21 is a split phase capacitor start induction motor having two windings 32, 34. In accordance with usual practice, ends 32*a*, 34*a* of windings 32, 34 are coupled, by means of a conductor 36 to terminal 66*a* of supply 66, whilst the other ends 32*b*, 34*b* are interconnected by a capacitor 38. End 34*b* is coupled to terminal 66*b* of supply 66 via normally open contacts 40 associated with relay coil 28. End 34*b* is also coupled to supply terminal 66*b* via first normally open contacts 42 associated with relay coil 30. Second normally open contacts 44 associated with relay coil 30 are interconnected between coil end 34*b* and one terminal of a semiconductor diode 46. The other terminal of the diode is coupled to coil end 32*b* via a resistor 48. The arrangement is thus such that when contacts 42 and 44 are operated terminal **34*b* is placed directly in communication with supply terminal 66*b* whilst coil end 32*b* can receive supply via resistor 48, diode 46 and contacts 44 and 42 from supply terminal 66*b***.

Figures 2, 3, 4, 5:
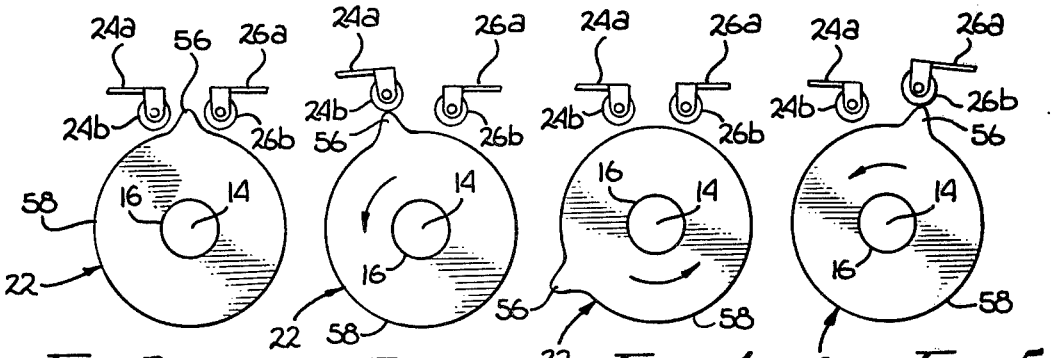
FIGS. 2 to 5 are plan views of a cam which controls operation of the door, the cam being shown at four consecutively occurring rotational positions.
Figure 6:
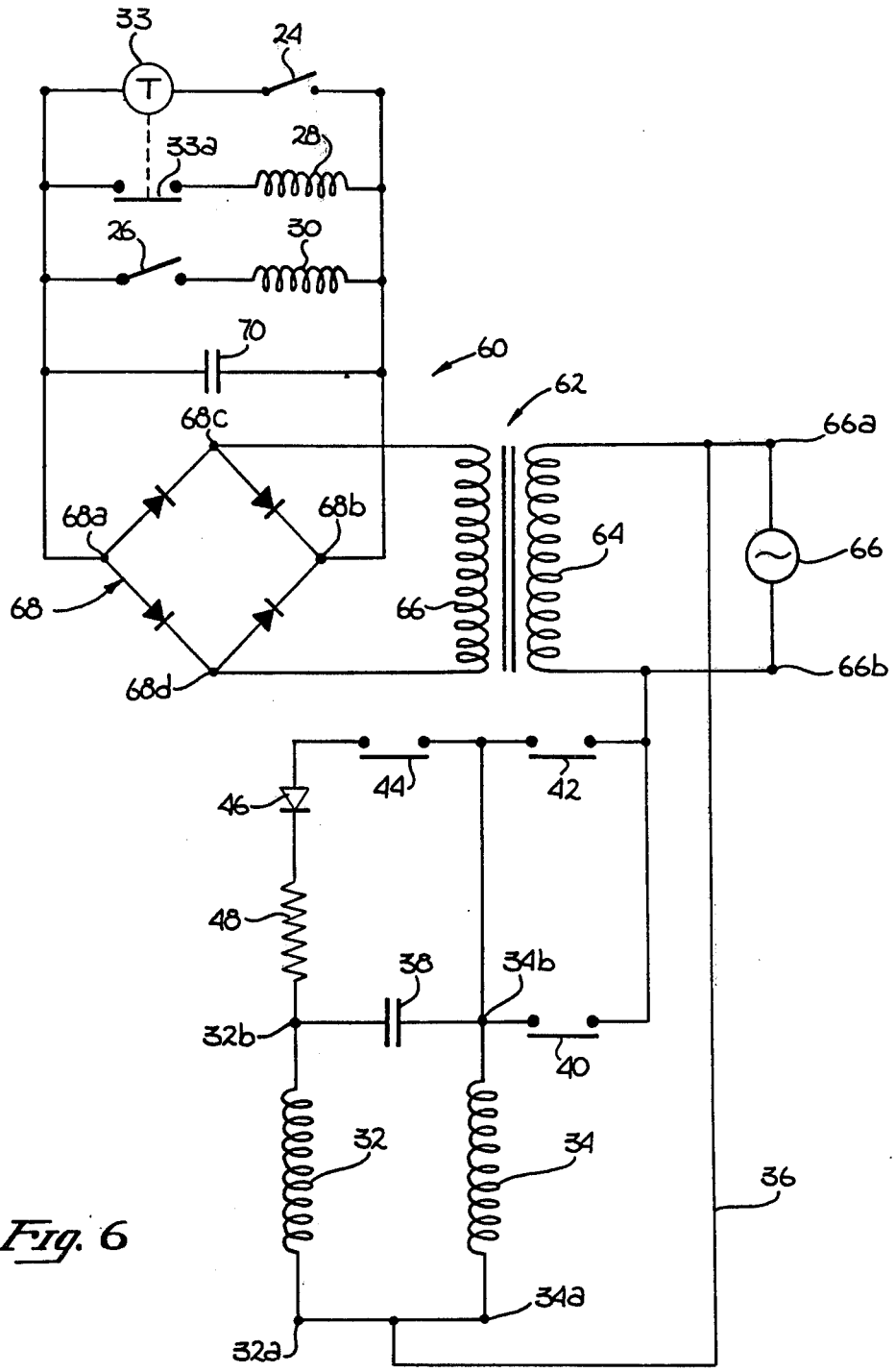
FIG. 6 is a circuit diagram of the electrical circuit controlling the operating motor of the door shown in FIG. 1.

In the normal unactuated condition of the revolving door, the lobe 56 of cam 22 is positioned between the rollers **24*b*, 26*b* and arms 24*a*, 26*a* assume, either by virtue of resiliant bias or by the natural resiliance of the arms, the position shown in FIG. 2 at which switches 24, 26 are not operated. If a user should push against one of the door panels 12 to rotate door 10 in the direction of arrow 80 in FIG. 1 cam 22 will be correspondingly rotated such that lobe 56 engages roller 24*b* and pushes arm 24*a* outwardly of the cam axis to momentarily operate switch 24. Operation of switch 24 initiates operation of timing circuit 33, thus closing contacts 33*a* to energise relay coil 28. Energisation of relay coil 28 causes closing of contacts 40 so that current from supply 66 can flow directly through winding 34 and can also flow through winding 32 via capacitor 38. Thus, motor 21 is operated to rotate door 10 about its axis, the direction of rotation of the motor shaft being such as to drive the door in the direction of arrow 80. Operation of motor 21 is arranged to continue for a predetermined period sufficient to cause the door to be revolved through an angle in the range 90 to 180 degrees. This period is determined by timing circuit 33, the timing circuit causing contacts 33*a* to be opened at the end of the predetermined period thereby de-energising relay coil 28 and opening contacts 40**.

FIG. 4 illustrates the approximate position of cam 22 at the end of this predetermined period, switch 24, of course, not being operated at this location because lobe 56 passed roller **24*b* substantially at the beginning of the period. After this degree of rotation has taken place, the door continues to revolve under its acquired momentum even though motor 21 is not operating. Rotation continues until almost 360 degrees of rotation has taken place, whereupon lobe 56 engages roller 26*b* (FIG. 5) to cause arm 26*a* to be pushed outwardly from the axis of the cam thereby actuating switch 26. Actuation of switch 26 causes energisation of relay coil 30, this in turn causing closing of contacts 42, 44 so that winding 34 of motor 21 is energised directly from supply 66 and winding 32 is energised with a uni-directional current flow via diode 46. This mode of energisation of the windings 32, 34 causes motor 21 to operate as a brake such that rotation of the door 10 is slowed to a very small, but continuing rate. In the absence of continued pushing by a user against a door panel 12 the door will come to rest when switch 26 is deactuated as lobe 56 of cam 22 passes roller 26*b*. In this respect, the speed of rotation of motor 21 in the braking mode is arranged to be insufficient to cause cam lobe 56 to continue, under its own momentum, to a degree of rotation sufficient to cause the lobe to operate switch 24. Thus the door will come to rest with cam 22 substantially in the condition shown in FIG. 2**, with the door ready for further use.

The described door is particularly convenient in use since power assistance is provided in a way which does not cause difference in the mode of use of the door as compared to the mode of use which is usual for non-power assisted revolving doors. Users are thus unlikely to be confused by the door as is likely to occur where specific and perhaps unusual actions are required by the user to cause operation of the door.

The drive from the drive motor is preferably such that rotation of the door can be stopped by a user if an emergency situation should arise. Thus, if something should become caught between one of the door panels 12 and a door opening (not shown) with which the door is associated, the motor is stalled readily without causing damage either it itself or to the article. The control circuit 60 may alternatively be modified as described in our copending application entitled "CONTROL CIRCUIT FOR ELECTRIC MOTORS" filed Feb. 7, 1975, to ensure motor turnoff under emergency conditions.

It should be noted that the door 10 is designed for operation by rotation in the direction of arrow 80. However, users cannot always be relied upon to revolve revolving doors in required directions and although the door is preferably disposed such as to encourage users to revolve the door in the required direction, it should be observed that there is no difficulty should a user revolve the door in the wrong direction. Thus, should this occur, some initial resistance to movement will at first occur as the door is moved away from rest. In this respect, the cam lobe 56 will at first operate switch 26 (as shown in FIG. 5) to apply braking to the door. But once this has occurred, the door can be revolved reasonably freely, although without power assistance, until a complete rotation has taken place and the user can pass from the door. The door will then reach a rotational position at which lobe 56 engages arm **24*a* so that switch 24 will then be operated to return the door to the condition of FIG. 2**. There is thus provided the additional advantage that, although the door can be operated in other than a desired direction, the user is not encouraged to do so.

FIGS. 7 to 17 show a modified door 110. This includes four upright planar door panels 112 which are arranged so as to extend outwardly in radial fashion from a common upright axis of rotation. The panels are so mounted that the door can be revolved about the upright axis by a user pushing against one of the door panels 112.

A shaft 116 at the upper end of the door and coaxial with the door axis is drivable, from a pulley 118 connected thereto, via an endless belt 120 from a pulley 119 connected to the output shaft of an electric motor 121. The upper end of shaft 116 carries two cams 122, 123 which cooperate with respective microswitches 124, 126 to control operation of motor 121.

As best seen from FIGS. 8 to 11, cam 122 is principally of circular configuration having an outer peripheral portion 158 which extends substantially 245° around the perimeter thereof, portion 158 being of constant radius as measured from the axis 114 of shaft 116. A single inward cut-out 156 of constant radius less than that of portion 158, and of small angular extent, is provided on the cam perimeter.

As best seen from FIGS. 12 to 15, cam 123 is principally of circular configuration having an outer peripheral portion 159 which extends substantially around the entire perimeter thereof, portion 159 being of constant radius as measured from the axis 114 of shaft 116. A single outward lobe 157 is provided on the cam periphery.

The operating arms **124*a*, 126*a* of the two microswitches 124, 126 carry rollers 124*b*, 126*b* which engage the peripheries of cams 122 and 123 at generally aligned locations. The switches 124, 126 are arranged in a control circuit 160 (FIG. 16) which supplies electrical current to motor 121. Circuit 160 includes a transformer 162 having its primary winding 164 coupled via a switch 165 to terminals 166***a*, 166*b* of an alternating current supply 166. The secondary winding 167 of transformer 162 is a low voltage winding and it is coupled across input terminals 168*c*, 168*d* of a bridge rectifier 168. A filter capacitor 170 is coupled across the output terminals 168*a*, 168*b* of rectifier 168 so that the output from the rectifier on terminals 168*a*, 168*b* is, substantially, a direct current voltage.

Switch 124 is connected in series with a relay coil 200 these together being coupled across terminals 168*a*, 168*b* so that when microswitch 124 is operated, voltage from rectifier 168 is applied (when switch 165 is closed) to energize coil 200 to cause it to close normally open contacts 200*a* associated therewith. Switch 126 is connected in series with a relay coil 130, these together being connected across terminals 168*a*, 168*b* so that assuming switch 165 to be closed, when switch 126 is operated, relay coil 130 is energized from rectifier 168. Energization of relay coil 130 causes closing of two sets of normally open contacts 130*a*, 130*b* associated therewith.

Motor 121 is a split phase capacitor start induction motor having two windings 132, 134. In accordance with usual practice, ends 132*a*, 134*a* of windings 132, 134 are coupled, by means of a conductor 136, to terminal 166*a* of supply 166, whilst the other ends 132*b*, 134*b* are interconnected by a capacitor 138. End 134*b* is coupled, via switch 165, to terminal 166*b* of supply 166 via the normally open contacts 200*a* associated with relay coil 200. Thus, with switch 165 closed, when contacts 200*a* are operated winding 134 receives supply directly from source 166 via contacts 200*a* and winding 132 receives out of phase supply via contacts 200*a* and capacitor 138. End 134*b* is also coupled via switch 165 to supply terminal 166*b* via normally open contacts 130*b* associated with relay coil 130. Normally open contacts 130*a* associated with relay coil 130 are interconnected between coil end 134*b* and one terminal of a semi-conductor diode 146. The other terminal of the diode is coupled to an end 132*b* of coil 132 (being the end opposite end 132*a*) via a resistor 148. The arrangement is thus such that, with switch 165 closed, when contacts 130*a* and 130*b* are operated terminal 134*b* is placed directly in communicaton with supply terminal 166*b*, by contacts 130*b*, whilst coil end 132*b* receives rectified supply via resistor 148, diode 146 and contacts 130*a* and 130*b* from supply terminal 166*b*.

In the normal, unactuated, condition of the revolving door, the cut out 156 of cam 122 is positioned so that roller 124*b* is therewithin and arm 124*a* assumes, either by virtue of external resilient bias or by the natural resilience of the arm, the position shown in FIG. 8 at which switch 124 is not operated. Similarly, at this rotational disposition of the door, the switch 126 is also not operated, roller 126*b* being positioned on the peripheral portion 159 of cam 123 immediately behind lobe 157 so that arm 126*a* assumes, either by natural resilience of the arm or by other resilient bias, the position shown in FIG. 12. If a user should push against one of the door panels 112 to rotate door 110 in the direction of arrow 180 in FIG. 7 cam 122 will be correspondingly rotated such that roller 124*b* is no longer within cut out 156, but engages the peripheral portion 158, whereby arm 124*a* is pushed outwardly of the axis 114 to operate switch 124. Assuming switch 165 to be closed, operation of switch 124 causes operation of motor 121, coil 200 being energized to close contacts 200*a* so that current from supply 166 can flow directly through winding 134 and can also flow through winding 132 via capacitor 138. Thus, motor 121 is operated to rotate door 110 about its axis, the direction of rotation of the motor shaft being such as to drive the door in the direction of arrow 180. As shaft 116 rotates pursuant to such driving, through the positions shown in FIGS. 9 and 10, the switch 124 is maintained operated. However, after a period of rotation corresponding to the circumferential extent of portion 158 of cam 122 the roller 124*b* again enters cut out 156 as shown in FIG. 11 so that contacts 200 are closed and normal operation of motor 166 is prevented. The corresponding extent of rotation of door panels 112 at which this occurs is chosen to be about 345°. Although switch 126 has previously been unactuated, by virtue of cam lobe 157 passing through the positions shown at FIGS. 12, 13 and 14, at which roller 126*b* remains engaged with the peripheral portion 159 thereof, lobe 157 is then positioned such that it engages roller 126*b* to push arm 126*a* outwardly to actuate switch 126 as shown in FIG. 15 this occurring immediately as switch 24 is deactuated. Then, contacts 130*a*, 130*b* are closed to supply alternating voltage from source 166 directly to winding 134 and to supply rectified current to winding 132 as previously described. In this mode, although motor 121 continues to turn in the direction indicated by arrow 180, the movement is slow. This movement continues until lobe 157 passes roller 126*b* to return the cams 122, 123 to the positions shown in FIG. 12. In this connection, neither switch 124 nor switch 126 is operated.

In order to ensure stopping of motor 121 at a position corresponding to 360° of rotation, arrangements as now described, are made for operating the motor 121 in a "stop" mode immediately the cams 122, 123, are reverted to the condition shown in FIGS. 8 and 12 respectively. Thus, relay coil 200 has a further set of contacts 200*c* associated therewith and relay coil 130 likewise has a further set of contacts 130*b*. Contacts 130*b* and 200*c* are both normally closed and are connected in series with a timing device 202 across terminals 168*a*, 168*b* of rectifier 168. Timing device 202 is connected to operate a pair of normally open contacts 202*a* which are connected in series with a relay coil 204 across terminals 168*a*, 168*b* of rectifier 168. During rotation of shaft 116 from the condition of FIG. 8 through those of FIGS. 9 and 10, contacts 200*c* are closed because relay coil 200 is energized, as previously described by virtue of closure of switch 24. At the rotational conditions shown in FIGS. 11 and 15, although contacts 200*c* are then closed, by virtue of deactuation of switch 124, contacts 130*b* are open by virtue of energization of relay coil 130 through closure of switch 126. Thus, it is only when 360° of rotation has taken place and the condition of FIGS. 8 and 12 is again reached that both coils 130 and 200 are deenergized and contacts 200*c*, 130*b* are closed. In this condition, voltage is applied to timing device 202 from rectifier 168 to cause closure of relay contacts 202*a* and energization of relay coil 204. Timing device 202 is, however, so constructed as to only close contacts 202*c* for a predetermined period, say, one second. Thus, relay coil 204 is energized for a corresponding period.

There are two sets of normally open contacts 204*a*, 204*b* associated with relay coil 204 and these are connected from terminal 166*a* of supply 166 so that, when closed, the ends 132*b*, 134*b* of windings 132, 134 are commoned and connected to terminal 166*a*. The result of this is to apply across the coils 132, 134 an in-phase voltage from supply 166 which causes a positive stopping action in motor 121 to bring it to rest precisely at the 360° rotation point.

Figures 16, 17:
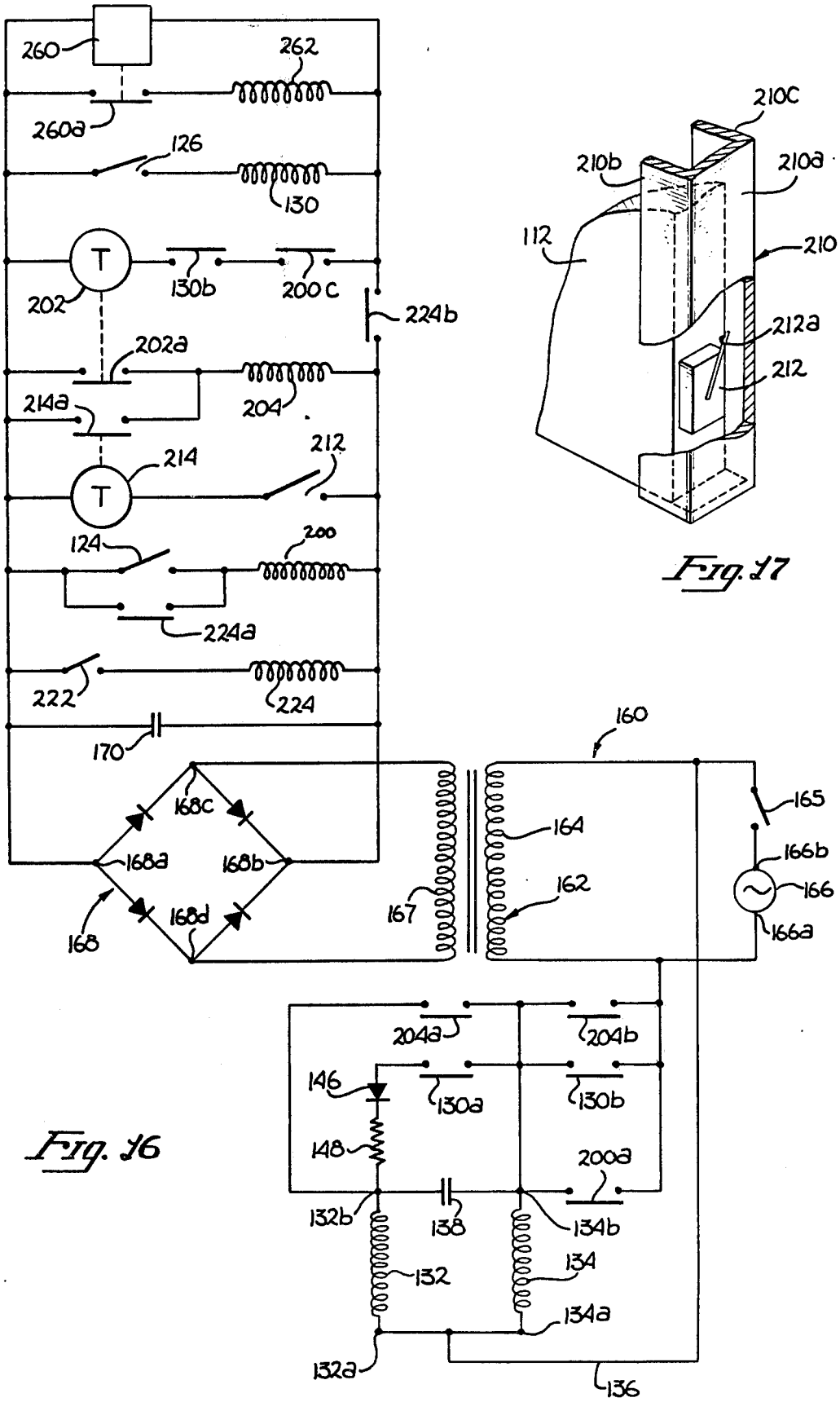
FIG. 16 is a circuit diagram of the electrical circuit controlling the operating motor of the door shown in FIG. 1.
FIG. 17 is a partly sectioned fragmentary perspective view of a lower outer corner of the door panel of the door of FIG. 7.

Each of the panels 112 has, along its outer edge a vertical strip 210 which is hingedly connected to that panel. The strips 210 are of generally U-shaped configuration in transverse section as shown in FIG. 17, comprising a web portion 210*a* and two side flanges 210*b*, 210*c*. The hinged connection of each to the associated panel by a pin 201 passing through the panel and said flanges. Outer upright edge portions of the panels 112 are accommodated within the strips 210, there edge portions projecting between the flanges 210*b*, 210*c*. At the foot of each panel 112, a separate microswitch 212 is positioned this being on the outer edge of the panel and positioned with its operating arm 212*a* engaged against the inside of web portion 210*a* of the associated strip 210. The arrangement is such that if a strip 210 is pushed inwardly towards the axis of shaft 216 the associated switch 212 is actuated. Thus, for example, if an object should become caught between the outer edge of a strip 210 and an upright edge 220 of a door opening with which the door 110 is associated, consequent inward deflection of the operating arm will occur and a switch 212 will be actuated.

The switches 212 are connected in parallel, and, for simplicity, only one is shown in FIG. 16. It is connected in series with a timing device 214 of known type, these together being connected across terminals 168*a*, 168*b* of rectifier 168. Timing device 214 has associated contacts 214*a* which are normally open, but which are closed for a predetermined period, say six seconds, when a switch 212 is closed to apply voltage from rectifier 168 to device 214. Contacts 214*a* are connected in parallel with the contacts 202*a* of timing device 202 and, when actuated, thereby serve to energize relay coil 204 for a predetermined period of about five seconds. Such operation will cause operation of relay contacts 204*a*, 204*b* to effect immediate stoppage of motor 121 as previously described. This stopping occurs for a period of five seconds and is usually sufficient to enable clearing of any obstruction from between a strip 210 and edge 220. After such stoppage, the door is returned to normal operating condition after the time period established by timing device 214.

Further protection against damage to objects or injury to persons as a result of such being caught in the door 110 may be provided by arranging the drive from motor 121 such that the motor is readily stalled in the event of obstruction or by arranging the drive from the motor such that drive slippage readily occurs in this condition. Again, the control circuit could be modified as described in our copending application entitled "CONTROL CIRCUIT FOR ELECTRIC MOTORS" filed Feb. 7, 1975, to ensure motor turnoff under emergency conditions.

Door 110 can also be conditioned so that motor 121 is continuously operated to cause rotation of the panels 112. For this purpose, a switch 222 is connected in series with a relay coil 224 across terminals 168*a*, 168*b* of rectifier 68. Coil 224 has two pairs of contacts 224*a*, 224*b* associated therewith. When the switch 222 is closed, coil 224 is energized and contacts 224*a*, 224*b* are operated. Contacts 224*a* are normally open but arranged to bridge switch 124 when coil 224 is energized so that coil 200 is then energized for as long as switch 222 is closed and the motor 121 is correspondingly rotated continuously. In order to prevent operation of contacts 130*a*, 130*b* and 204*a*, 204*b* as occurs during normal operation of the door 110, contacts 224, which are normally closed, are opened upon energization of relay coil 224 these contacts being connected in a line from terminal 168*b* of rectifier 168 to contacts 200*c*, 130*b* and relay coil 130 so that the relay coil 130 cannot be energized nor can timer 202. Operation of motor 121 in the braking condition is thus prevented by disconnection of rectifier supply to coil 130 and operation of the motor 121 in the stop condition is prevented by disconnection of rectifier supply to contacts 200*c*, 130*b*. However, actuation of contacts 224*b* does not prevent the supply of electric current from the rectifier 168 to timing device 214 via switches 212, when any of the latter are closed, so that relay coil 214 can still be energized by operation of a switch 212 to effect the described safety stopping action of motor 121. Switch 222 may be controlled by a device responsive to presence of a person nearby door 110 so that automatic operation of the door occurs when a user approaches the door. Such device may comprise an optical detector, pressure switch actuated by weight of a person thereon or, preferably, the detector 260 shown. Detector 260 is of a kind known per se and operates by generating high frequency sound waves and detecting reflections thereof as occur when an object is positioned within range of the detector. The detector is positioned to operate by detecting reflections of high frequency sound waves from persons approaching the door. It is connected across supply terminals 168*a*, 168*b* such as to close contacts 260*a* associated therewith when approach of a person is detected. Contacts 260*a* are in series with a relay coil 262 so that the relay coil is then energized to operate switch 222.

I claim:

1. A revolving door comprising at least one upright door element arranged in outwardly extending disposition about an upright axis of revolution, motor means being provided together with control means operable to position the door at a first rotational disposition from which, when the door is turned in one direction by a user pushing against said door element, power assistance is given to the door to effect rotation thereof wherein said control means includes first means responsive, upon movement of the door from said first rotational disposition in said one direction, to cause operation of said motor means to effect said power assistance for a predetermined time, limit means being provided to cause the door to then come to rest at said first rotational disposition, in the absence of continued pushing by said user, after movement of the door under action of said motor means, wherein said control means further includes second means responsive to positioning of said door at a second rotational disposition, advanced in said one direction from said first rotational disposition, to initiate operation of said limit means, wherein said motor means includes a split phase capacitor start induction motor and said first means includes a timing circuit and a first switch operable upon said movement of the door from said first rotational disposition to initiate operation of said timing circuit, said timing circuit operating to then apply electrical current from an electric supply to one winding of said motor to cause said operation thereof for said predetermined period, wherein said second means includes a second switch operated upon positioning of said door at said second rotational disposition, to operate said limit means, said limit means comprising said motor, said second means operating in response to operation of said second switch means to apply said supply to said one winding of said motor and a unidirectional current from said supply to the other winding thereof whereby said motor operates at low speed and acts as a brake, wherein said first and second switches are arranged to be operated by a cam which is rotated by the door during use thereof, and wherein said first and second switches have operating arms which extend towards and are resiliantly biased towards the cam periphery and the cam has a portion extending over most of its periphery, which portion is of constant radius, and a single outward lobe, the free ends of the arms being positioned such that at said first rotational disposition the lobe is positioned therebetween so that neither arm is moved substantially radially outwardly from rest positions thereof and neither switch is operated, said cam outwardly pressing the arm of the first switch during said turning of the door in said one direction from said first rotational disposition to momentarily operate the said first switch and outwardly pressing the arm of the second switch towards the end of a full revolution of the door to operate the second switch, the speed of said motor when acting as said brake being such as to normally prevent the door and cam from moving in said one direction under its own acquired momentum so far past the location at which the second switch becomes inoperative as to initiate operation of said first switch, unless the door is so moved by a user.

2. A revolving door as claimed in claim 1, wherein said time period is such that, by normal operation of the door, the said power assistance is provided to the door for rotation thereof over an angular extent of 90 to 180 degrees from said first rotational disposition and said second rotational disposition corresponds to a location less than but substantially equal to 360 degrees from said first rotational disposition in said one direction.

3. A revolving door as claimed in claim 1 wherein an upright outer edge of said door element away from said axis is provided with an inwardly depressible edge strip connected to switch means, said switch means being incorporated into an electric circuit of said control means for said motor means whereby to effect stopping of the door element during rotation thereof in the event of depression of the edge strip inwardly towards said axis whereby if an object or person should become caught between the edge and an upright edge of an entrance surround for the door, the strip will be depressed causing the door to stop.

4. A revolving door as claimed in claim 1 wherein an upright outer edge of said door element away from said axis is provided with an inwardly depressible edge strip connected to switch means, said switch means being incorporated into an electric circuit of said control means for said motor means whereby to effect stopping of the door element during rotation thereof in the event of depression of the edge strip inwardly towards said axis whereby if an object or person should become caught between the edge and an upright edge of an entrance surround for the door, the strip will be depressed causing the door to stop; said switch means being connected to effect said stopping by applying in-phase alternating currents to the two windings of the motor for at least a predetermined time period.

5. A revolving door as claimed in claim 4 wherein said switch means is connected to operate a timer which effects said applying in-phase alternating current for a short time period, whereafter the door is again conditioned for normal operation.

6. A revolving door as claimed in claim 1 wherein said control means includes switch means operable to cause the limit means to be deactuated and to cause said motor means to be operated to rotate said door element continuously whilst the switch is operated, without interruption by said limit means.

7. A revolving door as claimed in claim 6 wherein said switch means is arranged to be operated by a detector positioned close to the door and responsive to the presence of a person within the vicinity of the door.

8. A revolving door comprising at least one upright door element arranged in outwardly extending disposition about an upright axis of revolution, motor means being provided together with control means operable to position the door at a first rotational disposition from which, when the door is turned in one direction by a user pushing against said door element, power assistance is given to the door to effect rotation thereof; limit means being provided to cause the door to then come to rest at said first rotational disposition, in the absence of continued pushing by said user, after movement of the door under action of said motor means, wherein said motor means includes a split-phase induction motor having two windings connected to said control means, said control means, in normal use of the motor, applying out of phase alternating current from the supply to the windings to effect operation of the motor to provide said power assistance; said limit means including means operable, in use of the door, to apply in-phase alternating currents from said supply to said windings to stop the motor and bring said door to rest at said first rotational disposition, wherein said control means operates to slow said motor prior to application of said in-phase currents and after application of said out of phase currents for a predetermined rotation of the door element, said slowing being effected by applying alternating current from said supply to one said winding and a rectified current to the other said winding, and wherein said control means controls supply of currents to the motor through two cam operated switches thereof, cams associated with the switches being connected to be turned concomitantly with said door element, a first of said switches being actuated upon movement of the door in said one direction away from said first rotational disposition to effect said application of said out of phase currents to said motor windings, this switch being operated via a first of said cams, this being shaped so that said first switch is deactuated at a second disposition of said door element somewhat less than 360° of rotation of the door element past said first disposition, the said application of said alternating current to said one winding and said rectified current to said other winding being effected under control of the second of said switches operated by a second of said cams, which second cam is shaped to effect operation of said second switch at or shortly after the door element reaches said second disposition during rotation thereof, said second cam being shaped to deactuate said second switch when said first disposition is again reached during said rotation, said limit means being sensitive to deactuation of both said switches after substantially 360° of rotation of the door element has occurred, to apply said in-phase alternating currents to said windings for a preselected time period after said deactuation.

* * * * *